US005449489A

United States Patent [19]

Gettliffe et al.

[11] Patent Number: 5,449,489

[45] Date of Patent: Sep. 12, 1995

[54] HIGH TEMPERATURE IRON-CONTAINING GAS TURBINE ALLOYS CONTAINING GOLD

[75] Inventors: Roland Gettliffe; Franklin H. Cocks, both of Durham, N.C.

[73] Assignee: Duke University, Durham, N.C.

[21] Appl. No.: 314,230

[22] Filed: Sep. 28, 1994

Related U.S. Application Data

[60] Division of Ser. No. 990,559, Dec. 14, 1992, Pat. No. 5,374,393, which is a continuation-in-part of Ser. No. 769,579, Oct. 2, 1991, abandoned, which is a continuation-in-part of Ser. No. 571,934, Aug. 22, 1990, abandoned.

[51] Int. Cl.[6] ..... C22C 30/00; C22C 38/54

[52] U.S. Cl. ..... 420/35; 420/444; 420/584.1; 420/586.1

[58] Field of Search ..... 420/35, 444, 584.1, 420/586.1; 148/419, 442, 335, 336

[56] References Cited

U.S. PATENT DOCUMENTS

| | | | |
|---|---|---|---|
| 2,944,891 | 7/1960 | Cape | 420/444 |
| 3,853,548 | 12/1974 | Fairbanks et al. | 420/444 |
| 5,374,393 | 12/1994 | Gettiffe et al. | 420/444 |

*Primary Examiner*—David A. Simmons
*Assistant Examiner*—Margery S. Phipps

[57] ABSTRACT

Turbine engine alloys modified by the addition of small amounts of gold are found to have improved properties over similar alloys that do not contain Au. These improved alloys have special application in gas turbines and jet engines. Preferred composition ranges are (36 to 45) wt % Ni-(25 to 32) wt % Fe-(16 to 21) wt % Cr-(0.3 to 0.4) wt % Al-(0.3 to 0.4) wt % Ti-(0.6 to 0.8) wt % Mn-(0.3 to 0.4) wt % Cu-(0.02 to 0.05) wt % C-(0.02 to 20) wt % Au and (44 to 56) wt % Fe-(20 to 26) wt % Ni-(12 to 16) wt % Cr-(1 to 1.3) wt % Mo-(1.7 to 2.2) wt % Ti-(0.2 to 0.3) wt % V-(0.15 to 0.21) wt % Al-(0.001 to 0.003) wt % B-(0.15 to 0.21) wt % Mn-(0.3 to 0.7) wt % Si-(0.02 to 0.05) wt % C-(0.02 to 20) wt % Au.

2 Claims, No Drawings

HIGH TEMPERATURE IRON-CONTAINING GAS TURBINE ALLOYS CONTAINING GOLD

CROSS-REFERENCES TO RELATED APPLICATIONS

The present application is a divisional continuation-in-part of prior application Ser. No. 07/990,559, filed on Dec. 14, 1992 entitled "High Temperature Gas Turbine alloys containing Gold", now U.S. Pat. No. 5,374,393, which was a continuation-in-part application of prior application Ser. No. 07/769,579, filed on Oct. 2, 1991 entitled "Turbine Engine Alloys Containing Gold", now abandoned, which was a file-wrapper continuation-in-part application of prior application Ser. No. 07/571,934, filed on Aug. 22, 1990 entitled "Niobium Alloys Containing Gold", now abandoned.

TECHNICAL FIELD

This invention relates to crystalline or polycrystalline turbine engine alloys with improved properties. Of special interest are improved properties relating to elevated temperature service, especially resistance to oxidation

BACKGROUND ART

Superalloys are group VIIIA (Co, Fe, Ni) metal base alloys with large and varied amounts of alloying elements. Superalloys currently dominate high-temperature service applications, such as jet engines, up to the 1038°-1093° C. (1900°-2000° F.) range. Although superalloys are pushing the limits of their capabilities with little appreciable gain in operating temperature expected, the demand for still higher operating temperatures [1093°-1370° C. (2000°-2500° F.)] remains strong. What is therefore needed is a new alloy system based on a metal with a higher melting point than the superalloy base metals, nickel (1453° C.), cobalt (1495° C.) and iron (1535° C.). Niobium, with a melting point of 2468° C., appears to be one such material. Wadsworth and Froes [1989] reviewed the state-of-the-art for metallic materials and concluded that a major problem was the inherent lack of oxidation resistance of niobium alloys at high temperature. Hix, in U.S. Pat. No. 2,822,268, teaches the improvement of oxidation resistance in niobium alloys through the addition of titanium, aluminum, beryllium, carbon, cobalt, iron, manganese, molybdenum, nickel, silicon, tantalum, tungsten, vanadium, and zirconium in combined amounts of everything except titanium from one to twenty percent by weight. Rhodin, in U.S. Pat. No. 2,838,395, teaches the use of one to twenty five weight percent iron in conjunction with one to twenty percent aluminum in niobium alloys containing at least fifty five percent niobium to improve oxidation resistance. Rhodin, in U.S. Pat. No. 2,838,396, teaches the use of one to thirty weight percent chromium in conjunction with one to twenty percent aluminum in niobium alloys containing at least fifty five percent niobium to improve oxidation resistance. Thielemann, in U.S. Pat. No. 2,860,970, teaches the use of niobium alloys containing three to twenty percent chromium, two to eight percent aluminum, and three to ten percent vanadium for improved oxidation resistance. Rhodin, in U.S. Pat. No. 2,881,069, teaches the addition of five to twenty weight percent aluminum and in excess of five percent and up to twenty percent molybdenum to produce oxidation resistance. Rhodin, in U.S. Pat. No. 2,882,146, teaches the use of titanium, molybdenum, chromium, tantalum, vanadium, zirconium, aluminum, cobalt, iron, manganese, nickel, tungsten, beryllium, carbon, cerium, and silicon to produce oxidation resistance. Wainer, in U.S. Pat. No. 2,883,282, teaches the addition of rare earths including cerium, erbium, lanthanum, neodymium, praseodymium, together with at least one element selected from the group consisting of beryllium, titanium, aluminum, zirconium, chromium, silicon, and vanadium. Thielemann, in U.S. Pat. No. 2,907,654, teaches the use of tantalum, chromium, and tungsten to develop oxidation resistance in niobium alloys. Semmel, in U.S. Pat. No. 3,156,560, teaches the use of scandium, yttrium, and rare earth elements of the lanthanide series to develop alloys which are ductile at elevated temperatures. Bradley, Rausch, McAndrew, and Simcoe, in U.S. Pat. No. 3,168,380, teach the use of aluminum and silicon in specific atomic ratios with niobium to develop high temperature oxidation resistance. Jaffee, Williams, Bartlett, and Bradley, in U.S. Pat. No. 3,193,385, teach the addition of tantalum, tungsten, molybdenum, hafnium, zirconium, vanadium, chromium, and beryllium to develop superior strength qualities. Begley, Buckman, and Ammon, in U.S. Pat. No. 3,206,305, teach the use of tantalum, vanadium, zirconium, and hafnium, to develop high strength at elevated temperatures in niobium alloys. Amra, in U.S. Pat. No. 3,346,380, teaches the addition of tungsten and rhenium to niobium to develop ductility in niobium alloys as well as useful strength at elevated temperatures. None of these inventions teaches, however, the addition of gold to niobium or niobium alloys to develop oxidation resistance or mechanical properties.

None of this prior art teaches the addition of gold to niobium-containing alloys or to other high-temperature turbine engine alloys. These alloys are all invariably crystalline or polycrystalline. We have now discovered that gold additions to these alloys, both those that contain niobium as well as those that do not contain significant amounts of niobium, confer substantial beneficial improvements in the properties of these alloys. Such alloys can be expected to have application in turbine engines and turbine engine environments within a temperature range of 500°-1500° C. The following preferred embodiments demonstrate the scope and range of these improvements.

PREFERRED EMBODIMENTS

EXAMPLE I

In a first preferred embodiment, alloys of niobium based on the commercial alloy designated C103 (nominal composition: 9.6 wt % Hf-0.85 wt % Ti-balance Nb) with increasing Au content from 0.02 wt % to 20 wt % Au were prepared by arc melting these materials together in a water cooled copper hearth under an atmosphere of argon, said melting process being repeated until an acceptable degree of homogeneity is achieved. In the description of this composition, we have used the standard abbreviations for the elements rather than writing their common names in full. The symbol Au represents, of course, the element gold. In this first preferred embodiment, an alloy of niobium consisting essentially of 71.7 wt % Nb-7.7 wt % Hf-0.6 wt % Ti-20 wt % Au, the oxidation rate, measured in milligrams of weight gained per square centimeter of surface area per hour of exposure in air at 1000 degrees centigrade, was found to be 15.5. All of these alloys containing Au were heated in air at 1000 degrees centigrade and their average oxidation rate, was found to be 19.7 over the range of Au additions from 0.02 to 20. Similarly-prepared samples of the commercial C103 alloy that were exposed to the same conditions showed an average oxidation rate of 24.9. It is thus seen that the presence of the gold significantly reduced the overall oxidation rate. Surprisingly, for the alloy containing only 0.02 wt. % gold, the oxidation rate was found to be 22.1. Thus, the effect of gold additions is not linear with gold concentration. The beneficial effect of Au additions on reducing the oxidation rate was found to occur for alloys containing (65 to 90) wt % Nb-(7 to 10) wt % Hf-(0.6 to 0.85) wt % Ti-(0.02 to 20) wt % Au.

EXAMPLE II

In a second preferred embodiment, alloys based on a root alloy of composition 51 wt % Nb-25.5 wt % Co-13.5 wt % Cr-9 wt % Al-1 wt % Y with increasing Au content from 0.02 wt % to 20 wt % Au were prepared by are melting these materials together in a water cooled copper hearth under an atmosphere of argon, said melting process being repeated until an acceptable degree of homogeneity is achieved. In this second preferred embodiment, an alloy consisting essentially of 40.9 wt % Nb-20.5 wt % Co-10.5 wt % Cr-7.3 wt % Al, and 0.8 wt % Y-20 wt % Au, the oxidation rate, measured in milligrams of weight gained per square centimeter of surface area per hour of exposure in air at 1000 degrees centigrade, was found to be 0.021. All of these alloys containing Au were heated in air at 1000 degrees centigrade and their average oxidation rate, was found to be 0.056 over the range of Au additions from 0.02 to 20. Samples of the root alloy that were exposed to the same conditions showed an average oxidation rate of 0.097. It is thus seen that the presence of the gold significantly reduced the overall oxidation rate. The beneficial effect of Au additions on reducing the oxidation rate of the root alloy (51 wt % Nb-25.5 wt % Co-13.5 wt % Cr-9 wt % Al-1 wt % Y) was found to extend over the range of composition from essentially (40.9 to 51) wt % Nb-(20.5 to 25.5) wt % Co-(10.5 to 13.5) wt % Cr-(7.3 to 9) wt % Al-(0.8 to 1) wt % Y-(0.02 to 20) wt % Au.

EXAMPLE III

In a third preferred embodiment, alloys of niobium based on a root alloy of composition 80 wt % Nb-10 wt % Mo-10 wt % Al with increasing Au content from 0.02 wt % to 20 wt % Au were prepared by are melting these materials together in a water cooled copper hearth under an atmosphere of argon, said melting process being repeated until an acceptable degree of homogeneity is achieved. In this third preferred embodiment, an alloy of niobium consisting essentially of 76 wt % Nb-9.5 wt % Mo-9.5 wt % Al and 5 wt % Au, the oxidation rate, measured in milligrams of weight gained per square centimeter of surface area per hour of exposure in air at 1000 degrees centigrade, was found to be 7.43. All of these alloys containing Au were heated in air at 1000 degrees centigrade and their average oxidation rate, was found to be 13.95 over the range of Au additions from 0.02 to 20. Samples of the root alloy that were exposed to the same conditions showed an average oxidation rate of 20.78. It is thus seen that the presence of the gold significantly reduced the overall oxidation rate. The beneficial effect of Au additions on reducing the oxidation rate of the root alloy (80 wt % Nb-10 wt % Mo-10 wt % Al) was found to extend over the range of composition from essentially (64 to 80) wt % Nb-(8 to 10) wt % Mo-(8 to 10) wt % Al-(0.02 to 20) wt % Au.

EXAMPLE IV

In a fourth preferred embodiment, alloys based on a root alloy of composition 50 wt % Nb-20 wt % Ti-10 wt % Fe-10 wt % Ni-10 wt % Al with increasing Au content from 0.02 wt % to 20 wt % Au were prepared by are melting these materials together in a water cooled copper hearth under an atmosphere of argon, said melting process being repeated until an acceptable degree of homogeneity is achieved. In this fourth preferred embodiment, an alloy consisting essentially of 47.5 wt % Nb-19 wt % Ti-9.5 wt % Fe-9.5 wt % Ni-9.5 wt % Al and 5 wt % Au, the oxidation rate, measured in milligrams of weight gained per square centimeter of surface area per hour of exposure in air at 1000 degrees centigrade, was found to be 4.45. All of these alloys containing Au were heated in air at 1000 degrees centigrade and their average oxidation rate,was found to be 5.13 over the range of Au additions from 0.02 to 20. Samples of the root alloy that were exposed to the same conditions showed an average oxidation rate of 6.24. It is thus seen that the presence of the gold significantly reduced the overall oxidation rate. The beneficial effect of Au additions on reducing the oxidation rate of the root alloy (50 wt % Nb-20 wt % Ti-10 wt % Fe-10 wt % Ni-10 wt % Al) was found to extend over the range of composition from essentially (40 to 50) wt % Nb-(16 to 20) wt % Ti-(8 to 10) wt % Fe-(8 to 10) wt % Ni-(8 to 10) wt % Al-(0.02 to 20) wt % Au.

EXAMPLE V

In a fifth preferred embodiment, alloys of niobium based on a root alloy of composition 60 wt % Nb-15 wt % Ni-10 wt % Fe-5 wt % Mn-10 wt % Al with increasing Au content from 0.02 wt % to 20 wt % Au were prepared by are melting these materials together in a water cooled copper hearth under an atmosphere of argon, said melting process being repeated until an acceptable degree of homogeneity is achieved. In this fifth preferred embodiment, an alloy of niobium consisting essentially of 54.1 wt % Nb-13.5 wt % Ni-9 wt % Fe-4.4 wt % Mn-9 wt % Al and 10 wt % Au, the oxidation rate, measured in milligrams of weight gained per square centimeter of surface area per hour of exposure in air at 1000 degrees centigrade, was found to be 0.94. All of these alloys containing Au were heated in air at 1000 degrees centigrade and their average oxidation rate,was found to be 1.07 over the range of Au additions from 0.02 to 20. Samples of the root alloy that were exposed to the same conditions showed an average oxidation rate of 1.34. It is thus seen that the presence of the gold significantly reduced the overall oxidation rate. The beneficial effect of Au additions on reducing the oxidation rate of the root alloy (60 wt % Nb-15 wt % Ni-10 wt % Fe-5 wt % Mn-10 wt % A1) was found to extend over the range of composition from essentially (48 to 60) wt % Nb-(12 to 15) wt % Ni-(8 to 10) wt % Fe-(4 to 5) wt % Mn-(8 to 10) wt % Al-(0.02 to 20) wt % Au.

EXAMPLE VI

In a sixth preferred embodiment, alloys based on a root alloy of composition 47.5 wt % Nb-14 wt % Ni-14 wt % Fe-4.5 wt % Mn-14 wt % Al-5 wt % Ag with increasing Au content from 0.02 wt % to 20 wt % Au were prepared by arc melting these materials together in a water cooled copper hearth under an atmosphere of argon, said melting process being repeated until an acceptable degree of homogeneity is achieved. In this sixth preferred embodiment, an alloy consisting essentially of 45.1 wt % Nb-13.5 wt % Ni-13.5 wt % Fe-4.4 wt % Mn-13.5 wt % Al-5 wt % Ag and 5 wt % Au, the oxidation rate, measured in milligrams of weight gained per square centimeter of surface area per hour of exposure in air at 1000 degrees centigrade, was found to be 1.17. All of these alloys containing Au were heated in air at 1000 degrees centigrade and their average oxidation rate, was found to be 1.53 over the range of Au additions from 0.02 to 20. Samples of the root alloy that were exposed to the same conditions showed an average oxidation rate of 1.92. It is thus seen that the presence of the gold significantly reduced the overall oxidation rate. The beneficial effect of Au additions on reducing the oxidation rate of the root alloy (47.5 wt % Nb-14 wt % Ni-14 wt % Fe-4.5 wt % Mn-14 wt % Al-5 wt % Ag) was found to extend over the range of composition from essentially (38 to 47.5) wt % Nb-(11.2 to 14) wt % Ni-(11.2 to 14) wt % Fe-(3.6 to 4.5) wt % Mn-(11.2 to 14) wt % Al-(4 to 5)wt % Ag-(0.02 to 20) wt % Au.

EXAMPLE VII

In a seventh preferred embodiment, alloys of niobium based on a root alloy of composition 70 wt % Nb-23 wt % Cr-5 wt % Al-2 wt % Co with increasing Au content from 0.02 wt % to 20 wt % Au were prepared by arc melting these materials together in a water cooled copper hearth under an atmosphere of argon, said melting process being repeated until an acceptable degree of homogeneity is achieved. In this seventh preferred embodiment, an alloy of niobium consisting essentially of 66.4 wt % Nb-21.9 wt % Cr-4.8 wt % Al-1.9 wt % Co and 5 wt % Au, the oxidation rate, measured in milligrams of weight gained per square centimeter of surface area per hour of exposure in air at 1000 degrees centigrade, was found to be 1.49. All of these alloys containing Au were heated in air at 1000 degrees centigrade and their average oxidation rate, was found to be 1.84 over the range of Au additions from 0.02 to 20. Samples of the root alloy that were exposed to the same conditions showed an average oxidation rate of 2.56. It is thus seen that the presence of the gold significantly reduced the overall oxidation rate. The beneficial effect of Au additions on reducing the oxidation rate of the root alloy (70 wt % Nb-23 wt % Cr-5 wt % Al-2 wt % Co) was found to extend over the range of composition from essentially (56 to 70) wt % Nb-(18.4 to 23) wt % Cr-(4 to 5) wt % Al-(1.6 to 2) wt % Co-(0.02 to 20) wt % Au.

EXAMPLE VIII

In an eighth preferred embodiment, alloys based on a root alloy of composition 55 wt % Nb-28 wt % Fe-9 wt % Cr-2.5 wt % Al-5.5 wt % Co with increasing Au content from 0.02 wt % to 20 wt % Au were prepared by arc melting these materials together in a water cooled copper hearth under an atmosphere of argon, said melting process being repeated until an acceptable degree of homogeneity is achieved. In this eighth preferred embodiment, an alloy consisting essentially of 45.1 wt % Nb-13.5 wt % Ni-13.5 wt % Fe-4.4 wt % Mn-13.5 wt % Al-5 wt % Ag and 5 wt % Au, the oxidation rate, measured in milligrams of weight gained per square centimeter of surface area per hour of exposure in air at 1000 degrees centigrade, was found to be 0.33. All of these alloys containing Au were heated in air at 1000 degrees centigrade and their average oxidation rate,was found to be 0.88 over the range of Au additions from 0.02 to 20. Samples of the root alloy that were exposed to the same conditions showed an average oxidation rate of 1.98. It is thus seen that the presence of the gold significantly reduced the overall oxidation rate. The beneficial effect of Au additions on reducing the oxidation rate of the root alloy (55 wt % Nb-28 wt % Fe-9 wt % Cr-2.5 wt % Al-5.5 wt % Co) was found to extend over the range of composition from essentially (44 to 55) wt % Nb-(22.4 to 28) wt % Fe-(7.2 to 9) wt % Cr-(2 to 2.5) wt % Al-(4.4 to 55) wt % Co-(0.02 to 20) wt % Au.

EXAMPLE IX

In a ninth preferred embodiment, binary alloys of niobium with increasing Au content from 0.02 wt % to 40 wt % Au were prepared by arc melting these materials together in a water cooled copper hearth under an atmosphere of argon, said melting process being repeated until an acceptable degree of homogeneity is achieved. When these alloys were heated in air at 1000 degrees centigrade the average oxidation rate, measured in milligrams of weight gained per square centimeter of surface area per hour of exposure was found to be 19.6 Samples of niobium that were exposed to the same conditions showed an average oxidation rate of 57.5. It is thus seen that the presence of the gold significantly reduced the overall oxidation rate.

EXAMPLE X

In a tenth preferred embodiment, alloys of based on the commercial alloy designated Waspaloy (nominal composition: 58.2 wt % Ni-13.5 wt % Co-19.5 wt % Cr-1.3 wt % Al-3.0 wt % Ti-4.3 wt % Mo-0.08 wt % C-0.06 wt % Zr-0.006 wt % B) with increasing Au content from 0.02 wt % to 20 wt % Au were prepared by arc melting these materials together in a water cooled copper hearth under an atmosphere of argon, said melting process being repeated until an acceptable degree of homogeneity is achieved. In this tenth preferred embodiment, an alloy consisting essentially of 55.4 wt % Ni-7.7 wt % Co-14.4 wt % Cr-3.0 wt % Al-3.0 wt % Ti-1.6 wt % Mo-2.3 wt % W-1.6 wt % Ta-0.12 wt % C-0.11 wt % Zr-0.01 wt % B-0.76 wt % Nb-10 wt % Au, heated in air at 1000 degrees, had a 10% lower hardness, as measured by the Knoop method, than a similarly-prepared sample of the commercial alloy exposed to the same conditions. All of these alloys containing Au were heated in air at 1000 degrees centigrade and their average Knoop hardness was found to be 7% lower than similarly-prepared samples of the commercial Waspaloy alloy that were exposed to the same conditions. Such a decrease in hardness connotes a concomitant increase in desirable ductility. The beneficial effect of Au additions on reducing the Knoop hardness of Waspaloy was found to extend over the range of composition from essentially (46 to 59) wt % Ni-(10 to 14) wt % Co-(15 to 20) wt % Cr-(1 to 1.5) wt % Al-(2.2 to 3.2) wt % Ti-(3.3 to 4.4) wt % Mo-(0.02 to 0.08) wt % C-(0.05 to 0.06 wt % Zr-(0.004 to 0.006) wt % B-(0.02 to 20) wt % Au.

EXAMPLE XI

In a eleventh preferred embodiment, alloys based on a root alloy of composition 52.75 wt % Ti-20.75 wt % Cr-26.5 wt % Al with increasing Au content from 0.02 wt % to 20 wt % Au were prepared by arc melting these materials together in a water cooled copper hearth under an atmosphere of argon, said melting process being repeated until an acceptable degree of homogeneity is achieved. In this eleventh preferred embodiment, an alloy consisting essentially of 50.1 wt % Ti-19.7 wt % Cr-25.2 wt % Al-5 wt % Au, heated in air at 1000 degrees, was found to have a tightly adherent oxide layer. The root alloy exposed to the same conditions showed a much less adherent oxide layer. All of these alloys containing Au were heated in air at 1000 degrees centigrade and their oxide layer were adherent over the range of Au additions from 0.02 to 20. The beneficial effect of Au additions on improving oxide adherency of the root alloy (52.75 wt % Ti-20.75 wt % Cr-26.5 wt % Al) was found to extend over the range of composition from essentially (42 to 53) wt % Ti-(16 to 21) wt % Cr-(21 to 27) wt % Al-(0.02 to 20) wt % Au.

EXAMPLE XII

In a twelfth preferred embodiment, alloys based on a root alloy of composition 43.5 wt % Ti-18 wt % Al-35 wt % Nb-2.0 wt % Zr-1.5 wt % V with increasing Au content from 0.02 wt % to 20 wt % Au were prepared by arc melting these materials together in a water cooled copper hearth under an atmosphere of argon, said melting process being repeated until an acceptable degree of homogeneity is achieved. In this twelfth preferred embodiment, an alloy consisting essentially of 50.1 wt % Ti-19.7 wt % Cr-25.2 wt % Al-5 wt % Au, heated in air at 1000 degrees then subjected to Rockwell C hardness testing, the alloys were found to be ductile. The root alloy exposed to the same conditions cracked in a brittle manner during Rockwell C hardness testing. All of these alloys containing Au were heated in air at 1000 degrees centigrade and were ductile over the range of Au additions from 0.02 to 20. The beneficial effect of Au additions on improving ductility of the root alloy (43.5 wt % Ti-18 wt % Al-35 wt % Nb-2.0 wt % Zr-1.5 wt % V) was found to extend over the range of composition from essentially (34 to 44) wt % Ti-(14 to 18) wt % Al-(28 to 35) wt % Nb-(1.6 to 2) wt % Zr-(1.4 to 1.5) wt % V-(0.02 to 20) wt % Au.

EXAMPLE XIII

In a thirteenth preferred embodiment, alloys based on a root alloy of composition 65.6 wt % Ni-18.2 wt % Cr-5.9 wt % Al-5.8 wt % Ti-4.3 wt % Mo-0.1 wt % Y-0.1 wt % C with increasing Au content from 0.02 wt % to 20 wt % Au were prepared by arc melting these materials together in a water cooled copper hearth under an atmosphere of argon, said melting process being repeated until an acceptable degree of homogeneity is achieved. In this tenth preferred embodiment, an alloy consisting essentially of 62.3 wt % Ni-17.3 wt % Cr-5.6 wt % Al-5.5 wt % Ti-4.1 wt % Mo-0.1 wt % Y-0.1 wt % C-5 wt % Au, had a 13% lower hardness, as measured by the Knoop method, than the root alloy exposed to the same conditions. All of these alloys containing Au were heated in air at 1000 degrees centigrade and their average Knoop hardness,was found to be 9% lower than similarly-prepared samples of the commercial Waspaloy alloy that were exposed to the same conditions. Such a decrease in hardness connotes a concomitant increase in desirable ductility. The beneficial effect of Au additions on reducing the Knoop hardness of the root alloy (65.6 wt % Ni-18.2 wt % Cr-5.9 wt % Al-5.8 wt % Ti-4.3 wt % Mo-0.1 wt % Y-0.1 wt % C) was found to extend over the range of composition from essentially (52 to 66) wt % Ni-(14.5 to 18.5) wt % Cr-(4.6 to 6) wt % Al-(4.5 to 3.4 to 4.4) wt % Mo-(0.08 to 0.1) wt % Y-(0.02 to 0.1) wt % C-(0.02 to 20) wt % Au.

EXAMPLE XIV

In a fourteenth preferred embodiment, alloys based on the commercial alloy designated Incoloy 800 (nominal composition: 45 wt % Ni-32 wt % Fe-21 wt % Cr-0.4 wt % Al-0.4 wt % Ti-0.75 wt % Mn-0.4 wt % Cu-0.05 wt % C) with increasing Au content from 0.02 wt % to 20 wt % Au were prepared by arc melting these materials together in a water cooled copper hearth under an atmosphere of argon, said melting process being repeated until an acceptable degree of homogeneity is achieved. In this fourteenth preferred embodiment, an alloy consisting essentially of 40.5 wt % Ni-28.8 wt % Fe-18.9 wt % Cr-0.38 wt % Al-0.38 wt % Ti-0.7 wt % Mn-0.3 wt % Cu-0.04 wt % C-10 wt % Au, the oxidation rate, measured in milligrams of weight gained per square centimeter of surface area per hour of exposure in air at 1000 degrees centigrade, was found to be 0.067. All of these alloys containing Au were heated in air at 1000 degrees centigrade and their average oxidation rate,was found to be 0.074 over the range of Au additions from 0.02 to 20. Similarly-prepared samples of the commercial alloy that were exposed to the same conditions showed an average oxidation rate of 0.084. It is thus seen that the presence of the gold significantly reduced the overall oxidation rate. The beneficial effect of Au additions on reducing the oxidation rate of Incoloy 800 was found to extend over the range of composition from essentially (36 to 45) wt % Ni-(25 to 32) wt % Fe-(16 to 21) wt % Cr-(0.3 to 0.4) wt % Al-(0.3 to 0.4) wt % Ti-(0.6 to 0.8) wt % Mn-(0.3 to 0.4) wt % Cu-(0.05) wt % C-(0.02 to 20) wt % Au.

EXAMPLE XV

In a fifteenth preferred embodiment, alloys based on the commercial alloy designated Inconel 718 (nominal composition: 52.5 wt % Ni-18.5 wt % Fe-19 wt % Cr-0.5 wt % Al-0.9 wt % Ti-5 wt % Nb-3 wt % Mo-0.18 wt % Mn-0.18 wt % Si-0.15 wt % Cu-0.04 wt % C) with increasing Au content from 0.02 wt % to 20 wt % Au were prepared by arc melting these materials together in a water cooled copper hearth under an atmosphere of argon, said melting process being repeated until an acceptable degree of homogeneity is achieved. In this fifteenth preferred embodiment, an alloy consisting essentially of 49.9 wt % Ni-17.6 wt % Fe-18.05 wt % Cr-0.48 wt % Al-0.85 wt % Ti-4.75 wt % Nb-2.85 wt % Mo-0.17 wt % Mn-0.17 wt % Si-0.14 wt % Cu-0.04 wt % C-5 wt % Au, the oxidation rate, measured in milligrams of weight gained per square centimeter of surface area per hour of exposure in air at 1000 degrees centigrade, was found to be 0.117. All of these alloys containing Au were heated in air at 1000 degrees centigrade and their average oxidation rate,was found to be 0.127 over the range of Au additions from 0.02 to 20. Similarly-prepared samples of the commercial alloy that were exposed to the same conditions showed an average oxidation rate of 0.143. It is thus seen that the presence of the gold significantly reduced the overall oxidation rate. The beneficial effect of Au additions on reducing the oxidation rate of Inconel 718 was found to extend over the range of composition from essentially (42 to 53) wt % Ni-(14.6 to 18) wt % Fe-(15 to 19) wt % Cr-(0.4 to 0.5) wt % Al-(0.7 to0.9) wt % Ti-(4 to 5) wt % Nb-(2.4 to 3) wt % Mo-(0.14 to 0.18) wt % Mn-(0.14 to 0.18) wt % Si-(0.12 to 0.15) wt % Cu-(0.02 to 0.04) wt % C-(0.02 to 20) wt % Au.

EXAMPLE XVI

In a sixteenth preferred embodiment, alloys based on the commercial alloy designated Haynes 214 (nominal composition: 76.5 wt % Ni-3 wt % Fe-16 wt % Cr-4.5 wt % Al-0.1 wt % Y) with increasing Au content from 0.02 wt % to 20 wt % Au were prepared by arc melting these materials together in a water cooled copper hearth under an atmosphere of argon, said melting process being repeated until an acceptable degree of homogeneity is achieved. In this sixteenth preferred embodiment, an alloy consisting essentially of 72.6 wt % Ni-2.85 wt % Fe-15.2 wt % Cr-4.26 wt % Al-0.09 wt % Y-5 wt % Au, the oxidation rate, measured in milligrams of weight gained per square centimeter of surface area per hour of exposure in air at 1000 degrees centigrade, was found to be 0.018. All of these alloys containing Au were heated in air at 1000 degrees centigrade and their average oxidation rate,was found to be 0.021 over the range of Au additions from 0.02 to 20. Similarly-prepared samples of the commercial alloy that were exposed to the same conditions showed an average oxidation rate of 0.026. It is thus seen that the presence of the gold significantly reduced the overall oxidation rate. The beneficial effect of Au additions on reducing the oxidation rate of Haynes 214 was found to extend over the range of composition from essentially (61.2 to 76.5) wt % Ni-(2.4 to 3) wt % Fe-(12.8 to 16) wt % Cr-(3.6 to 4.5) wt % Al-(0.08 to 0.1) wt % Y-(0.02 to 20) wt % Au.

EXAMPLE XVII

In a seventeenth preferred embodiment, alloys based on the commercial alloy designated B1900+Hf (nominal composition: 63.4 wt % Ni-10 wt % Co-8 wt % Cr-6 wt % Al-1 wt % Ti-4.25 wt % Ta-6 wt % Mo-1.15 wt % Hf-0.08 wt % Zr-0.015 wt % B-0.11 wt % C) with increasing Au content from 0.02 wt % to 20 wt % Au were prepared by arc melting these materials together in a water cooled copper hearth under an atmosphere of argon, said melting process being repeated until an acceptable degree of homogeneity is achieved. In this seventeenth preferred embodiment, an alloy consisting essentially of 57.07 wt % Ni-9 wt % Co-7.2 wt % Cr-5.4 wt % Al-0.9 wt % Ti-3.82 wt % Ta-5.4 wt % Mo-1.04 wt % Hf-0.07 wt % Zr-0.01 wt % B-0.09 wt % C-10 wt % Au, the oxidation rate, measured in milligrams of weight gained per square centimeter of surface area per hour of exposure in air at 1000 degrees centigrade, was found to be 0.031. All of these alloys containing Au were heated in air at 1000 degrees centigrade and their average oxidation rate,was found to be 0.033 over the range of Au additions from 0.02 to 20. Similarly-prepared samples of the commercial alloy that were exposed to the same conditions showed an average oxidation rate of 0.039. It is thus seen that the presence of the gold significantly reduced the overall oxidation rate. The beneficial effect of Au additions on reducing the oxidation rate of B1900+Hf was found to extend over the range of composition from essentially (50.7 to 63.4) wt % Ni-(8 to 10) wt % Co-(6.4 to 8) wt % Cr-(4.8 to 6) wt % Al-(0.8 to 1) wt % Ti-(3.4 to 4.25) wt % Ta-(4.8 to 6) wt % Mo-(0.92 to 1.15)wt % Hf-(0.06 to 0.06) wt % Zr-(0.012 to 0.015) wt % B-(0.02 to 0.11) wt % C-(0.02 to 20) wt % Au.

EXAMPLE XVIII

In a eighteenth preferred embodiment, alloys based on the commercial alloy designated Haynes 188 (nominal composition: 22 wt % Ni-3 wt % Fe-37.2 wt % Co-22 wt % Cr-14 wt % W-1.25 wt % Mn-0.35 wt % Si-0.075 wt % La-0.015 wt % B-0.1 wt % C) with increasing Au content from 0.02 wt % to 20 wt % Au were prepared by arc melting these materials together in a water cooled copper hearth under an atmosphere of argon, said melting process being repeated until an acceptable degree of homogeneity is achieved. In this eighteenth preferred embodiment, an alloy consisting essentially of 20.9 wt % Ni-2.85 wt % Fe-35.34 wt % Co-20.9 wt % Cr-13.3 wt % W-1.19 wt % Mn-0.34 wt % Si-0.07 wt % La-0.01 wt % B-0.1 wt % C-5 wt % Au, the oxidation rate, measured in milligrams of weight gained per square centimeter of surface area per hour of exposure in air at 1000 degrees centigrade, was found to be 0.015. All of these alloys containing Au were heated in air at 1000 degrees centigrade and their average oxidation rate, was found to be 0.017 over the range of Au additions from 0.02 to 20. Similarly-prepared samples of the commercial alloy that were exposed to the same conditions showed an average oxidation rate of 0.019. It is thus seen that the presence of the gold significantly reduced the overall oxidation rate. The beneficial effect of Au additions on reducing the oxidation rate of Haynes 188 was found to extend over the range of composition from essentially (17.6 to 22) wt % Ni-(2.4 to 3) wt % Fe-(29.7 to 37.2) wt % Co-(17.6 to 22) wt % Cr-(11.2 to 14) wt % W-(1 to 1.25) wt % Mn-(0.28 to 0.35) wt % Si-(0.06 to 0.075) wt % La-(0.012 to 0.015) wt % B-(0.02 to 0.1) wt % C-(0.02 to 20) wt % Au.

EXAMPLE XIX

In a nineteenth preferred embodiment, alloys based on a root alloy of composition 64.7 wt % Ni-8 wt % W-5.5 wt % Co-7.5 wt % Cr-5.8 wt % Al-1.25 wt % Mo-6.75 wt % Ta-0.5 wt % Ti with increasing Au content from 0.02 wt % to 20 wt % Au were prepared by arc melting these materials together in a water cooled copper hearth under an atmosphere of argon, said melting process being repeated until an acceptable degree of homogeneity is achieved. In this nineteenth preferred embodiment, an alloy consisting essentially of 61.5 wt % Ni-7.6 wt % W-5.2 wt % Co-7.1 wt % Cr-5.5 wt % Al-1.2 wt % Mo-6.4 wt % Ta-0.5 wt % Ti-5 wt % Au, the oxidation rate, measured in milligrams of weight gained per square centimeter of surface area per hour of exposure in air at 1000 degrees centigrade, was found to be 0.253. A similarly-prepared sample of the commercial alloy exposed to the same conditions showed an oxidation rate of 0.287. All of these alloys containing Au were heated in air at 1000 degrees centigrade and their average oxidation rate,was found to be 0.266 over the range of Au additions from 0.02 to 20. It is thus seen that the presence of the gold significantly reduced the overall oxidation rate. The beneficial effect of Au additions on reducing the oxidation rate of the root alloy (64.7 wt % Ni-8 wt % W-5.5 wt % Co-7.5 wt % Cr-5.8 wt % Al-1.25 wt % Mo-6.75 wt % Ta-0.5 wt % Ti) was found to extend over the range of composition from essentially (51.7 to 64.7) wt % Ni-(6.4 to 8) wt % W-(4.4 to 5.5) wt % Co-(6 to 7.5) wt % Cr-(4.6 5.8) wt % Al-(1 to 1.25) wt % Mo-(5.4 to 6.8) wt % Ta-(0.4 to 0.5) wt % Ti-(0.02 to 20) wt % Au.

EXAMPLE XX

In a twentieth preferred embodiment, alloys based on the commercial alloy designated MarM200+Hf (nominal composition: 58.3 wt % Ni-10 wt % Co-9 wt % Cr-5 wt % Al-2 wt % Ti-12.5 wt % W-2 wt % Hf-1 wt % Nb-0.015 wt % B-0.14 wt % C) with increasing Au content from 0.02 wt % to 20 wt % Au were prepared by arc melting these materials together in a water cooled copper hearth under an atmosphere of argon, said melting process being repeated until an acceptable degree of homogeneity is achieved. In this twentieth preferred embodiment, an alloy consisting essentially of 52.5 wt % Ni-9 wt % Co-8.1 wt % Cr-4.5 wt % Al-1.8 wt % Ti-11.25 wt % W-1.8 wt % Hf-0.9 wt % Nb-0.01 wt % B-0.13 wt % C-10 wt % Au, the oxidation rate, measured in milligrams of weight gained per square centimeter of surface area per hour of exposure in air at 1000 degrees centigrade, was found to be 0.09 1. A similarly-prepared sample of the commercial alloy exposed to the same conditions showed an oxidation rate of 0.115. All of these alloys containing Au were heated in air at 1000 degrees centigrade and their average oxidation rate,was found to be 0.099 over the range of Au additions from 0.02 to 20. It is thus seen that the presence of the gold significantly reduced the overall oxidation rate. The beneficial effect of Au additions on reducing the oxidation rate of MarM200+Hf was found to extend over the range of composition from essentially (46.6 to 58.3) wt % Ni-(8 to 10) wt % Co-(7.2 to 9) wt % Cr-(4 to 5) wt % Al-(1.6 to 2) wt % Ti-(10 to 12.5) wt % W-(1.6 to 2) wt % Hf-(0.8 to 1) wt % Nb-(0.012 to 0.015) wt % B-(0.02 to 0.14) wt % C-(0.02 to 20) wt % Au.

EXAMPLE XXI

In a twenty-first preferred embodiment, alloys based on the commercial alloy designated Inconel 738 (nominal composition: 61.5 wt % Ni-8.5 wt % Co-16 wt % Cr-3.4 wt % Al-3.4 wt % Ti-2.6 wt % W-1.75 wt % Mo-1.75 wt % Ta-0.12 wt % Zr-0.85 wt % Nb-0.012 wt % B-0.13 wt % C) with increasing Au content from 0.02 wt % to 20 wt % Au were prepared by arc melting these materials together in a water cooled copper hearth under an atmosphere of argon, said melting process being repeated until an acceptable degree of homogeneity is achieved. In this twenty-first preferred embodiment, an alloy consisting essentially of 58.4 wt % Ni-8.1 wt % Co-15.2 wt % Cr-3.2 wt % Al-3.2 wt % Ti-2.5 wt % W-1.7 wt % Mo-1.7 wt % Ta-0.1 wt % Zr-0.8 wt % Nb-0.01 wt % B-0.1 wt % C-5 wt % Au, the oxidation rate, measured in milligrams of weight gained per square centimeter of surface area per hour of exposure in air at 1000 degrees centigrade, was found to be 0.094. All of these alloys containing Au were heated in air at 1000 degrees centigrade and their average oxidation rate,was found to be 0.103 over the range of Au additions from 0.02 to 20. Similarly-prepared samples of the commercial alloy that were exposed to the same conditions showed an average oxidation rate of 0.112. It is thus seen that the presence of the gold significantly reduced the overall oxidation rate. The beneficial effect of Au additions on reducing the oxidation rate of Inconel 738 was found to extend over the range of composition from essentially (42 to 53) wt % Ni-(14.8 to 18.5) wt % Fe-(15.2 to 19) wt % Cr-(0.4 to 0.5) wt % Al-(0.7 to 0.9) wt % Ni-(14.8 to 18.5) wt % Fe-(15.2 to 19) wt % Cr-(0.18) wt % Mn-(0.14 to 0.18) wt % Si-(0.12 to 0.15) wt % Cu-(0.02 to 0.04) wt % C-(0.02 to 20) wt % Au.

EXAMPLE XXII

In a twenty-second preferred embodiment, alloys based on the commercial alloy designated Haynes 21 (nominal composition: 62.55 wt % Co-2 wt % Ni-27 wt % Cr-1 wt % Fe-6 wt % Mo-0.6 wt % Mn-0.6 wt % Si-0.25 wt % C) with increasing Au content from 0.02 wt % to 20 wt % Au were prepared by arc melting these materials together in a water cooled copper hearth under an atmosphere of argon, said melting process being repeated until an acceptable degree of homogeneity is achieved. In this twenty-second preferred embodiment, an alloy consisting essentially of 56.3 wt % Co-1.8 wt % Ni-24.3 wt % Cr-0.9 wt % Fe-5.4 wt % Mo-0.54 wt % Mn-0.54 wt % Si-0.22 wt % C-10 wt % Au, the oxidation rate, measured in milligrams of weight gained per square centimeter of surface area per hour of exposure in air at 1000 degrees centigrade, was found to be 0.018. All of these alloys containing Au were heated in air at 1000 degrees centigrade and their average oxidation rate,was found to be 0.021 over the range of Au additions from 0.02 to 20. Similarly-prepared samples of the commercial alloy that were exposed to the same conditions showed an average oxidation rate of 0.31. It is thus seen that the presence of the gold significantly reduced the overall oxidation rate. The beneficial effect of Au additions on reducing the oxidation rate of Haynes 21 was found to extend over the range of composition from essentially (50 to 63) wt % Co-(1.6 to 2) wt % Ni-(21 to 27) wt % Cr-(0.8 to 1 ) wt % Fe-(4.8 to 6) wt % Mo-(0.48 to 0.6) wt % Mn-(0.48 to 0.6) wt % Si-(0.02 wt % C-(0.02 to 20) wt % Au.

EXAMPLE XXIII

In a twenty-third preferred embodiment, alloys based on the commercial alloy designated A-286 (nominal composition: 25 wt % Ni-15 wt % Cr-1.25 wt % Mo-2.15 wt % Ti-0.3 wt % V-0.2 wt % Al-0.003 wt % B-0.2 wt % Mn-0.7 wt % Si-0.05 wt % C-balance Fe) with increasing Au content from 0.02 wt % to 20 wt % Au were prepared by arc melting these materials together in a water cooled copper hearth under an atmosphere of argon, said melting process being repeated until an acceptable degree of homogeneity is achieved. In this twenty-third preferred embodiment, an alloy consisting essentially of 52.38 wt % Fe-23.75 wt % Ni-14.25 wt % Cr-1.19 wt % Mo-2.04 wt % Ti-0.29 wt % V-0.19 wt % Al-0.0029 wt % B-0.19 wt % Mn-0.67 wt % Si-0.047 wt % C-5 wt % Au, the oxidation rate, measured in milligrams of weight gained per square centimeter of surface area per hour of exposure in air at 1000 degrees centigrade, was found to be 0.081. All of these alloys containing Au were heated in air at 1000 degrees centigrade and their average oxidation rate,was found to be 0.090 over the range of Au additions from 0.02 to 20. Similarly-prepared samples of the commercial alloy that were exposed to the same conditions showed an average oxidation rate of 0.130. It is thus seen that the presence of the gold significantly reduced the overall oxidation rate. The beneficial effect of Au additions on reducing the oxidation rate of A-286 was found to extend over the range of composition from essentially (44 to 56) wt % Fe-(20 to 26) wt % Ni-(12 to 16) wt % Cr-(1 to 1.3) wt % Mo-(1.7 to 2.2)wt % Ti-(0.2 to 0.3) wt % V-(0.15 to 0.21) wt % Al-(0.001 to 0.003) wt % B-(0.15 to 0.21)

wt % Mn-(0.3 to 0.7) wt % Si-(0.02 to 0.05) wt % C-(0.02 to 20) wt % Au.

It has been found that the beneficial effect of gold increases with the weight percentage of gold contained within the alloy, with sensible benefit being obtained even when the amount of gold present within the alloy is 0.02 weight percent.

In the process of oxidation, oxygen diffuses into the high temperature superalloy root alloy in advance of the actual metal-oxide interface. This diffusion of oxygen causes the metal to become brittle and susceptible to fracture, which accelerates the oxidation process. The most obvious symptom of this diffusion is a hard "case" about the outer surface of a sample cross-section. It has been found that increasing Au additions dramatically reduce this case. It appears that no more than 10 wt % Au is necessary for this effect to occur, with larger additions only serving to decrease the overall hardness of the resulting alloy. As an example of the ability of Au to reduce the diffusion rate of oxygen, a sample of C-103 exposed to 1000 degrees in air was found to exhibit a "case" 800 Knoop units harder than the interior of the alloy specimen. An equivalent alloy with 10 wt % Au was found to exhibit a virtually uniform hardness cross-section with no detectable case. The addition of Au is thus a process for reducing the diffusion rate of oxygen in high temperature superalloys for use in gas turbines. This process consists essentially of the addition of 0.02 to 20 wt % Au to a high temperature superalloy root alloy It is to be understood that in all of these alloys, there will be present small amounts of elements which exist unavoidably as contaminants and that the presence or absence of these contaminants will not affect the essential composition of the alloys as disclosed in this present invention. For the majority of turbine engine alloys, the component elements other than Au are preferably selected from the group consisting of Co, Cr, Fe, Al, Ti, Ni, Mo, Nb, Hf, Ag, Mn, Zr, V, Y, C, Cu, Si, La, Ta, W. Additionally this group can be sub-divided into major elements selected from the group consisting of Co, Cr, Fe, Ti, Ni, Mo, Nb, and minor elements selected from the group consisting of Al, Hf, Ag, Mn, Zr, V, Y, C, Cu, Si, La, Ta, W.

It is thus seen that the present invention provides,a process for reducing the oxidation rate of high temperature superalloys for use in gas turbines, this process consisting essentially of the addition of 0.02 to 20 wt % Au to a high temperature superalloy root alloy. As shown by the embodiments, the root alloy composition is, in each case, the nominal composition of commercial alloys.

What is claimed is:

1. A high temperature gas turbine alloy containing iron, said alloy consisting essentially of: (36 to 45) wt % Ni-(25 to 32) wt % Fe-(16 to 21) wt % Cr-(0.3 to 0.4) wt % Al-(0.3 to 0.4) wt % Ti-(0.6 to 0.8) wt % Mn-(0.3 to 0.4) wt % Cu-(0.02 to 0.05) wt % C-(0.02 to 20) wt % Au.

2. A high temperature gas turbine alloy containing iron, said alloy consisting essentially of: (44 to 56) wt % Fe-(20 to 26) wt % Ni-(12 to 16) wt % Cr-(1 to 1.3) wt % Mo-(1.7 to 2.2) wt % Ti-(0.2 to 0.3) wt % V-(0.15 to 0.21) wt % Al-(0.001 to 0.003) wt % B-(0.15 to 0.21) wt % Mn-(0.3 to 0.7) wt % Si-(0.02 to 0.05) wt % C-(0.02 to 20) wt % Au.

* * * * *